United States Patent [19]

Burdick

[11] 4,382,642

[45] May 10, 1983

[54] BEAM FURNITURE SYSTEM

[76] Inventor: Bruce A. Burdick, 1620 Montgomery St., San Francisco, Calif. 94111

[21] Appl. No.: 192,079

[22] Filed: Sep. 29, 1980

[51] Int. Cl.[3] ..... A47B 27/00

[52] U.S. Cl. ..... 312/194; 312/195; 312/254; 248/188.7

[58] Field of Search ..... 312/195, 194, 197, 254, 312/256, 111, 140; 403/233, 234; 248/188.7, 159

[56] References Cited

U.S. PATENT DOCUMENTS

| | | | |
|---|---|---|---|
| 48,854 | 7/1865 | Ustick . | |
| 1,873,932 | 8/1932 | Hunter | 312/195 |
| 2,529,780 | 11/1950 | Miller | 248/159 |
| 2,987,362 | 6/1961 | Bernath | 312/195 |
| 3,104,138 | 9/1963 | Renaud | 312/195 |
| 3,236,485 | 2/1966 | Staples | 248/188.7 |
| 3,666,339 | 5/1972 | Neufeld . | |
| 3,712,698 | 1/1973 | Propst et al. . | |
| 3,751,127 | 8/1973 | Black, Jr. et al. | 312/111 |
| 3,770,334 | 11/1973 | Weber | 312/194 |
| 3,814,778 | 6/1974 | Hosoda et al. | 312/214 |
| 3,856,372 | 12/1974 | Carlson et al. | 312/254 |
| 3,883,202 | 5/1975 | Konig | 312/195 |
| 3,911,190 | 10/1975 | Myers et al. | 312/214 |
| 3,955,788 | 5/1976 | Delage . | |
| 3,964,401 | 6/1976 | Gutmann, Jr. et al. | 312/194 |
| 4,049,331 | 9/1977 | Gutmann, Jr. | 312/195 |
| 4,050,752 | 9/1977 | Dykstra | 312/195 |
| 4,101,183 | 7/1978 | McManus | 312/195 |
| 4,224,769 | 9/1980 | Ball et al. | 52/36 |
| 4,287,837 | 9/1981 | Bayles | 312/195 |

FOREIGN PATENT DOCUMENTS

| | | | |
|---|---|---|---|
| 675737 | 2/1962 | Italy | 312/194 |
| 347318 | 8/1960 | Switzerland | 312/195 |

OTHER PUBLICATIONS

Product Analysis Race System, by J. Roger Guilfoyle, Sep. 1978, p. 122.

A Refined Way to Develope Workstations from a Power Handling Beam, by Richard Planck, Jan. 1980, p. 111.

Taking the Shock Out of Futures, No Listed Author, Jun. 1982, p. 17.

Race, Published by Sunar, Design Douglas Ball, Publication Data Unknown, p. RS2578.

*Primary Examiner*—Victor N. Sakran

*Attorney, Agent, or Firm*—Varnum, Riddering, Wierengo & Christenson

[57] ABSTRACT

A furniture system has a pedestal supported, rigid support beam (101) and a selection of functional furniture items attachable thereto with various types of bracket assemblies. The support beam (101) is elongated and rectangular in cross section with two rounded upper flanges (128) and two rectangularly shaped lower flanges (129) radially extending from a rectangular central portion (126, 127) thereof. The bracket assemblies can be secured around certain of the radially extending flanges at a continuum of locations along the support beam. A pedestal structure (102) is connectable to the support beam (101) at certain positions along the lower radially extending flanges (129). The furniture items include various sizes and shapes of work surfaces, storage files, and supporting stands for accessories such as telephones and calculators. Separate beams can be joined together at right angles to each other.

28 Claims, 31 Drawing Figures

BEAM FURNITURE SYSTEM

BACKGROUND OF THE INVENTION

1. Field of the Invention

This invention relates to furniture and, more particularly, relates to structures adapted to provide both simple and complex furniture arrangements having a plurality of selectively positionable furniture items.

2. State of the Prior Art

Modern industrial and commercial business organizations often require allocation of substantial portions of their budgets to the purchase of office furniture equipment. However, office managers and/or purchasing agents responsible for the purchase of such office equipment typically encounter numerous difficulties therewith. Personnel having various occupational classifications often require differing furniture arrangements. However, a particular manufacturer or distributor of office furniture equipment will sometimes manufacture or stock furniture arrangements directed only to certain limited occupations and tasks. For example, one distributor may only sell furniture equipment comprising secretarial personnel desk arrangements and file storage structures. Another distributor may sell only "executive-type" furniture arrangements. Accordingly, the office manager responsible for purchasing all office furniture equipment is required to seek out a plurality of distributors and/or manufacturers, thereby losing the monetary and convenience advantages often achieved when purchasing in bulk from a single distributor or manufacturer.

Even when a single office furniture manufacturer or distributor can provide furniture arrangements for all occupational classifications of personnel, the office manager encounters other difficulties. Typically, most furniture arrangements are substantially "fixed" as to their structure and to the particular tasks for which they are most advantageously utilized. For example, the office manager may purchase a certain number of conference tables and a certain number of secretarial desks. However, due to personnel, building architecture, or other like changes which occur with every industrial or commercial organization from time to time, the previously purchased inventory of furniture arrangements may no longer fit the needs of the organization. Such changes often require additional furniture arrangement purchases and also sale of existing office furniture at substantial losses. Accordingly, negative cash flow occurs although inventory book value does not substantially increase.

Further, in view of the rapid modernization of business functions, lack of adaptability of furniture arrangements may cause difficulties even when no personnel or building arrangement changes occur. For example, with computerized word processing coming into widespread use, a secretary may suddenly require a desk arrangement having a place for a combination cathode-ray tube (CRT), keyboard, and cassette tape system rather than a mere stand for a typewriter. Additionally, with even relatively small organizations now having computerized inventory processing, an executive may require a furniture arrangement having a location for a remote computer terminal without necessitating reduction of work surfaces adapted for other tasks. Numerous other examples exist of furniture arrangement modifications necessitated by computerization of information processing and telecommunications.

An additional problem somewhat related to those previously discussed with respect to fixed furniture arrangements can be viewed in light of objective needs of personnel having equivalent levels of certain occupational classifications. For example, an organization may have a number of executives of equivalent level (e.g., assistant vice-presidents) but with each executive having responsibilities which differ as to their involved tasks. One executive may spend a substantial portion of work time in meetings, while another may have extensive writing duties. Still another may spend an inordinate amount of time on the telephone or performing dictation. Such executives all require "executive-type" furniture arrangements, but it is advantageous to provide each with a furniture arrangement structurally adapted to his or her particular objective needs.

Another problem can exist with fixed furniture arrangements for persons having equivalent levels of certain occupational classifications. Though such persons may also have equivalent duties and, accordingly, equivalent objective needs, modern personnel psychology makes clear that it is advantageous to also provide for a person's subjective needs within a work environment. For example, two executives may each have duties and tasks which are substantially "meeting" intensive. However, one of the executives may desire a long, narrow work surface while the other desires a substantially different furniture arrangement.

Numerous other examples exist of varying furniture arrangements which may be classified as meeting other objective and subjective needs of personnel. One person may need a furniture arrangement whereby he or she can work comfortably at all positions around a desk surface. Other persons may need desk surfaces surrounding them on two or possibly three sides. Still others may need a large amount of file storage.

Several prior art structures provide limited adaptability of use of specific pieces of furniture. For example, U.S. Pat. No. 3,666,339, J. W. Neufeld, issued May 30, 1972, discloses a metal desk arrangement having a removable clip on attachment which could be connected to corners of a desk top for secretarial or similar purposes. However, the Neufeld patent is not directed to the problem of providing an integrated furniture system for the "total" work situation of an organization. Similarly, none of the prior art arrangements can be characterized as a complete singular furniture system capable of providing the degree of versatility of structural arrangements and selectively of removable furniture items necessary to meet the differing objective and subjective needs of personnel having the occupational classifications normally found in industrial or commercial business organizations.

SUMMARY OF THE INVENTION

Advantageously, a technical advance is achieved in an office furniture system adapted to provide a plurality of furniture arrangements. Each furniture arrangement in accordance with the invention comprises selectively removable functional furniture components wherein the type of furniture components utilized in any one furniture arrangement can be varied in accordance with objective and subjective needs of the user.

The furniture components of the office furniture system comprise variously sized work surfaces, storage files, desk files and trays. A furniture support means is adapted to support and position the furniture components in differing spacial arrangements. A pedestal means positions the furniture support means in a horizontal plane at a selective height relative to a ground level. Bracket assemblies are provided to connect the furniture components to the support means.

The furniture support means comprises a first linear support beam having a plurality of radially extending flanges wherein the bracket assemblies are removably clampable to at least two of the flanges. Additionally, the bracket assemblies can be attached to the flanges at any of a continuum of locations along the first support beam. Means are also provided to perpendicularly connect a second linear support beam to the first support beam.

The pedestal means comprises a base means resting on ground level for effecting stabilization of the pedestal. A vertically extending leg member is connectible to the base means and adapted to position the furniture support means at a predetermined height relative to ground level. The pedestal means further comprises means for connecting the furniture support means to the vertically extending leg member.

The first linear support beam is symmetrical about a vertical plane and comprises a rectangularly-shaped portion integrally connected to the radially extending flanges. The flanges comprise a pair of rounded upper flanges and a pair of rectangularly shaped lower flanges. Slots are provided in the lower flanges for retention of a cover plate to conceal wiring and like materials.

The bracket assemblies comprise a work surface assembly connectible to the first support beam for supporting and positioning any of the variously sized work surfaces in a horizontal plane above a horizontal plane extending through the beam. File bracket assemblies are provided to connect and position desk files below the horizontal plane of the first support beam. Additional assemblies, including a machine table bracket, are connectable to the support beam for supporting various furniture components in a plane substantially equivalent to the horizontal plane of the beam. Center bracket assemblies support furniture components directly above the beam.

In accordance with the invention, an exemplary structure for a work surface bracket assembly comprises a pair of top brackets each having an elongated arm extending perpendicularly to the linear structure of the first support beam when the bracket assembly is secured to the beam. A pair of attaching flanges are each integrally connected to one of the elongated arms and comprise vertical bores extending therethrough. A pair of central connecting portions are each connected integrally to the elongated arms and comprise inner surfaces shaped in a reflective manner to the shape of the rounded upper flanges of the support beam. Means are receivable through the vertical bores of the attaching flanges to secure the top brackets to the work surfaces. Clip means are provided to rigidly secure each of the top brackets to the support beam.

DETAILED DESCRIPTION

Figure 1:
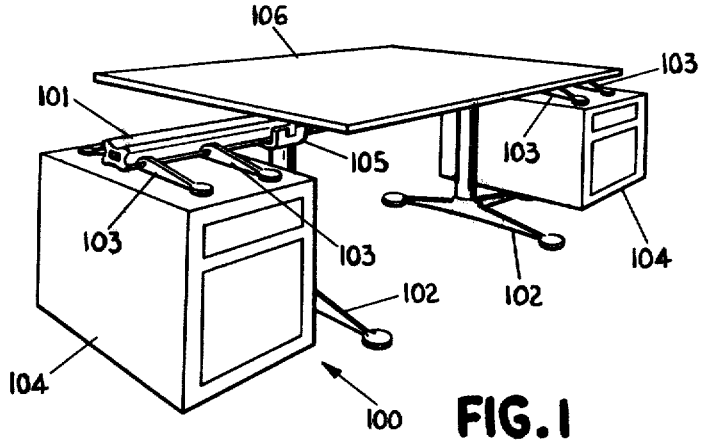
FIG. 1 is a perspective view of an illustrative embodiment of a desk arrangement in accordance with the invention.

The principles of this invention are disclosed in an office furniture system having various structures which can be utilized to selectively construct numerous types of furniture arrangements. Three exemplary furniture arrangements in accordance with the invention are depicted in FIGS. 1 through 29 of the drawing and comprise various functional furniture components designated as "furniture items." FIG. 1 depicts an illustrative furniture arrangement 100 comprising furniture items work surface 106 and a pair of desk files 104. Structural support for the furniture items desk files 104 and work surface 106 is provided by a linear rail means comprising a support beam 101 supportably positioned above ground level by pedestal means comprising a pair of pedestal assemblies 102 as shown in FIG. 1. Selective connection and supportive attachment of various furniture items to the support beam 101 is provided by bracket means comprising various types of bracket assemblies, each of which is connectable at a continuum of locations along beam 101. Specifically with respect to furniture arrangement 100, each of the desk files 104 is supportably attached below the beam 101 by means of a pair of file bracket assemblies 103. Additionally, the work surface 106 is positioned above the beam 101 and is supportably attached thereto by means of a pair of work surface bracket assemblies designated as top bracket assemblies 105, one of which is perspectively shown in FIG. 1.

Figure 2:
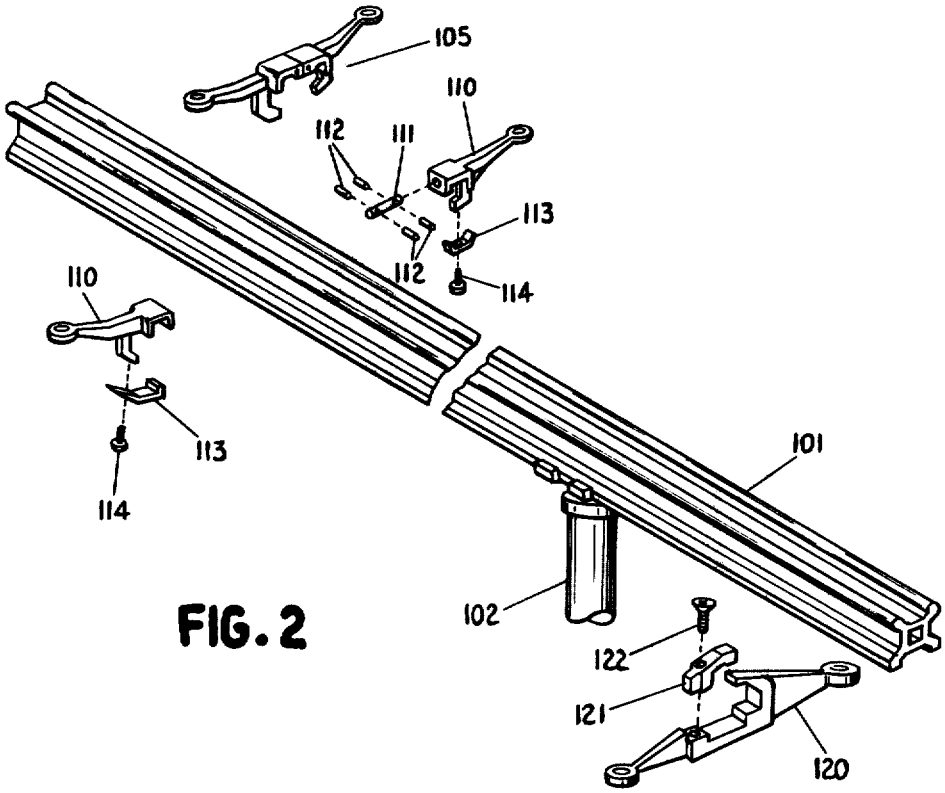
FIG. 2 is an exploded view of a support beam pedestal assembly, work surface bracket assembly, and file bracket assembly of the furniture arrangement shown in FIG. 1.

FIG. 2 depicts, in perspective view, the support beam 101 and a portion of the pedestal assembly 102 attached thereto, each of which was previously shown in FIG. 1. Also shown in FIG. 2 is an exploded view of one of the top bracket assemblies 105. The top bracket assembly 105 comprises a pair of equally structure desk top brackets 110. Top brackets 110 attach directly to the previously depicted work surface 106 and rest on the upper portion of support beam 101 in a manner which will be more clearly depicted in subsequent figures of the drawing. The top brackets 110 are connected together by means of a connecting pin 111 and secured by two pairs of set screws 112. The bracket assembly 105 further comprises a pair of clips 113 which are utilized to secure the assembly to the lower portion of the support beam 101. Each of clips 113 is connected to one of the top brackets 110 by means of a cap screw 114 as shown in FIG. 2.

FIG. 2 further depicts an exploded view of one of the file bracket assemblies 103 shown in FIG. 1. The file bracket assembly 103 comprises a file bracket 120 which is attachable directly to the desk file 104 previously shown in FIg. 1. The file bracket 120 is secured to the support beam 101 by means of a clamp 121 which is directly attached to the bracket 120 via a flat head screw 122.

Figure 3:
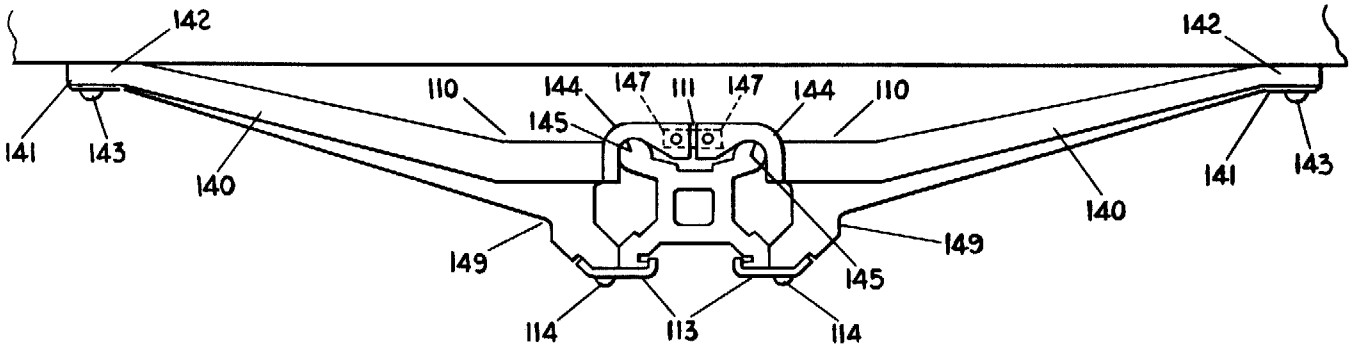
FIG. 3 is an end view of the support beam with the work surface secured thereto via the work surface bracket assembly.
Figure 3A:
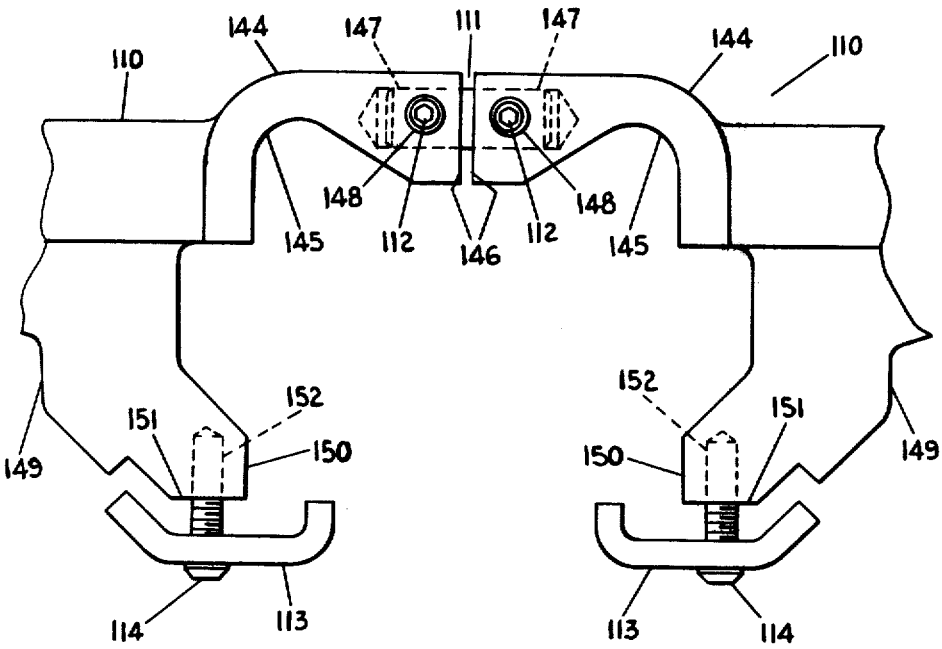
FIG. 3A is an enlarged view of the central portion of the work surface bracket assembly depicted in FIG. 3.
Figure 3B:
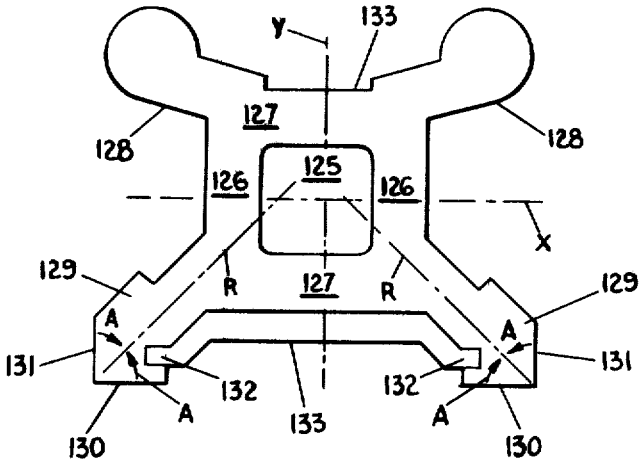
FIG. 3B is an enlarged view of the support beam depicted in FIG. 3.

Referring now to FIGS. 3, 3*a* and 3*b*, support beam 101 has a work surface 106 secured thereto by top bracket assembly 105. As shown in FIG. 3*b*, support beam 101 is symmetrical about a vertical Y axis and comprises a rectangularly shaped portion having an inner spacial area 125 extending linearly through the beam. Spacial area 125 can be utilized for wire management functions. The rectangularly shaped portion of beam 101 comprises, around the spacial area 125, vertical sections 126 and horizontal sections 127. Radially extending from, and integral with, the vertical sections 126 and the top horizontal section 127 are two rounded upper flanges 128 extending linearly along beam 101. The upper surface of the top horizontal section 127 connecting the upper rounded flanges 128 comprises a slightly recessed surface 133 extending linearly along the support beam 101. The linearly extending surfaces of flanges 128 can be utilized to support various furniture system elements in accordance with the invention other than merely work surface 106. As will be depicted in subsequent figures of the drawing, these various furniture system elements are generally maintained on horizontal planes above the plane formed by the X axis through beam 101 shown in FIG. 3. Radially extending from and integral with the vertical sections 126 and the bottom horizontal section 127 are two lower flanges 129. Each of lower flanges 129 terminates in a horizontal surface 130 and a vertical surface 131. Each of surfaces 130 and 131 form an angle A of 45° with one of the axes R wherein the axes R correspond to radial axes of support beam 101 and to median axes of each of lower flanges 129. The inner surface of each of lower flanges 129 extending between the bottom horizontal section 127 and the horizontal surface 130 comprises a slot 132 as shown in FIG. 3. Slots 132 can be utilized to retain a cover plate 133 or the like to conical wiring linearly extending along the support beam 101. Beam 101 can comprise any of numerous types of materials such as various stainless steel alloys or chrome plated steel known in the art for structural strength and reliability.

Figure 4:
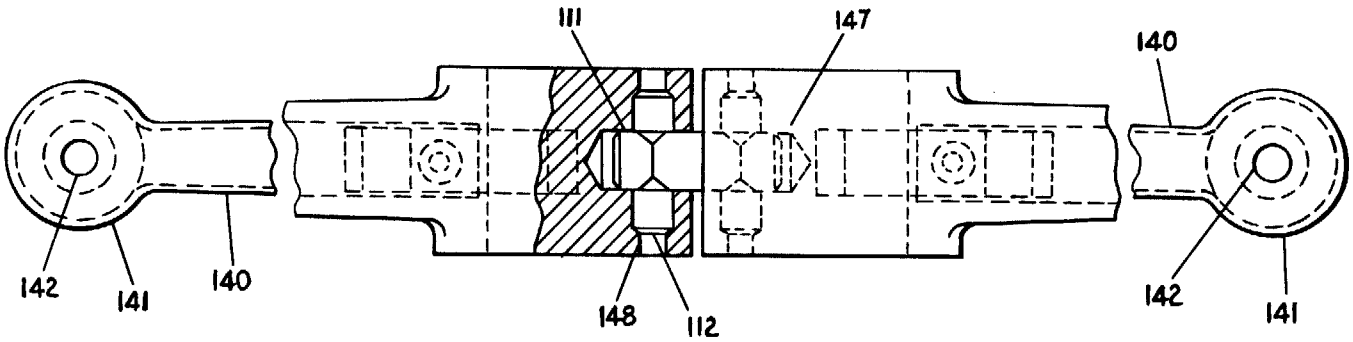
FIG. 4 is a top view of the work surface bracket assembly.

FIG. 3 depicts an end view of top bracket assembly 105 and the structural cooperation thereof with beam 101 to provide support of work surface 106. FIG. 4 illustrates a top view of top bracket assembly 105 independent of beam 101 and work surface 106 for purposes of further clarification. Top bracket assembly 105 comprises two top brackets 110, a pin 111, set screws 112, clips 113, and a pair of cap screws 114. As illustrated in both FIGS. 3 and 4 of the drawing, each of the top brackets 110 comprises an elongated arm 140 which extends in a perpendicular manner to the linear structure of support beam 101. Further, each of elongated arms 140 terminates integrally with an attaching flange 141 utilized to secure top bracket assembly 105 to the work surface 106. Each of attaching flanges 141 comprises a vertical bore 142 extending completely therethrough. Bores 142 also extend partially into the bottom surface of desk top 106 and connecting means such as the cap screws 143 shown in FIG. 3 may be threadably received through the bottom attaching flanges 141 to secure work surface 106 thereto.

The elongated arms 140 are also integral with central connecting portions 144 which are utilized to provide support of top bracket assembly 105 upon the beam 101. Each of central connecting portions 144 comprises an inner surface 145 shaped in a manner reflective of the shape of the previously described rounded upper flanges 128 of beam 101 and cooperable therewith to provide the requisite vertical support. Further, the connecting portions 144 each have facing vertical surfaces 146 with horizontal bores 147 therethrough. A connecting pin 111, previously described with respect to FIG. 2, can be received into each of horizontal bores 147 to connect together the brackets 110. Pin 111 can be secured to each of connecting portions 144 by means of set screws 112 threadably received through horizontal bores 148 which are perpendicular to bores 147.

The elongated arms 140 comprise lower return flanges 149 as shown in FIG. 3. Each lower return flange 149 terminates in an inner vertical surface 150 and a lower horizontal surface 151. The top brackets 110 are further secured to beam support 101 by means of clips 113 which are connected to lower return flanges 149 by means of cap screws 114 threadably received into vertical bores 152 through both clips 114 and lower horizontal surfaces 151 as shown in FIG. 3. The cap screws 114 are threadably engaged into vertical bores 152 to an extent such that inner vertical surfaces 150 abut the vertical surfaces 131 of beam 101 and lateral and lineal movement of bracket assembly 105 with respect to beam 101 is prohibited. It is noted that particular securing elements, i.e. cap screws, set screws, etc., are not necessary for connection of furniture apparatus in accordance with the invention. Other connection means may be utilized without departing from the novel concepts of the invention.

Figure 5:
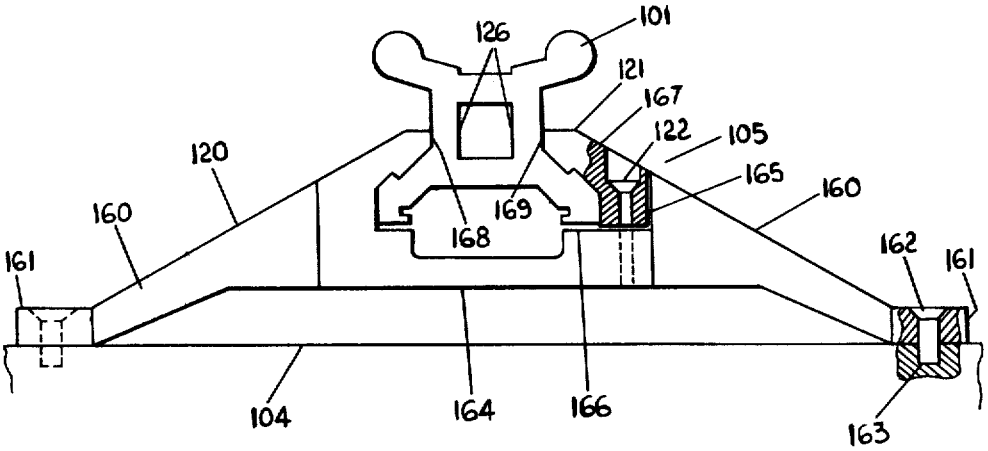
FIG. 5 is an end view of the support beam with a desk file secured thereto by means of the file bracket assembly.

FIG. 5 is an end view of support beam 101 with desk file 104 secured thereto by means of file bracket assembly 103. Bracket assembly 103 comprises the file bracket 120 previously depicted in FIG. 2. Bracket 120 comprises a pair of elongated arms 160 which extend perpendicularly and downward from the lineal structure of beam 101. The elongated arms 160 terminate in attaching flanges 161 with vertical bores 162 extending completely therethrough and also extending partially through desk file 104. One of the attaching flanges 161 is shown broken away in FIG. 5 to illustrate that connecting means such as flat head screws 163 can be threadably received into the top of attaching flanges 161 and desk file 104 to supportably suspend the desk file thereto. The elongated arms 160 are joined together in an integral manner by means of a lower connecting portion 164.

One of the elongated arms 160 terminates in a vertical surface 165 and a horizontal surface 166 as shown in FIG. 5. For purposes of securing bracket assembly 103 to the support beam 101, the claim 121, previously depicted in FIG. 2, is connected to file bracket 120 such that vertical and horizontal surfaces of the clamp 121 abut the vertical surface 165 and horizontal surface 166, respectively. Clamp 121 is partially broken away to show a flat head screw 122 through vertical bore 167 for threadably engaging clamp 121 to file bracket 120. The other of elongated arms 160 and the clamp 121 comprise vertical surfaces 168 and 169 respectively, which abut the previously described vertical sections 126 of support beam 101. Bracket assembly 105 is thereby secured to the support beam 101 in a manner sufficient to prohibit any substantial lateral or lineal movement of the desk file 104 with respect to support beam 101. It should be noted that neither top bracket assembly 105 nor file bracket assembly 103 is restricted in attachment to any specific location along support beam 101. Accordingly, such furniture items as work suface 106 and files 104 can be utilized with numerous furniture arrangements differing in accordance with the needs of the user.

Figure 6:
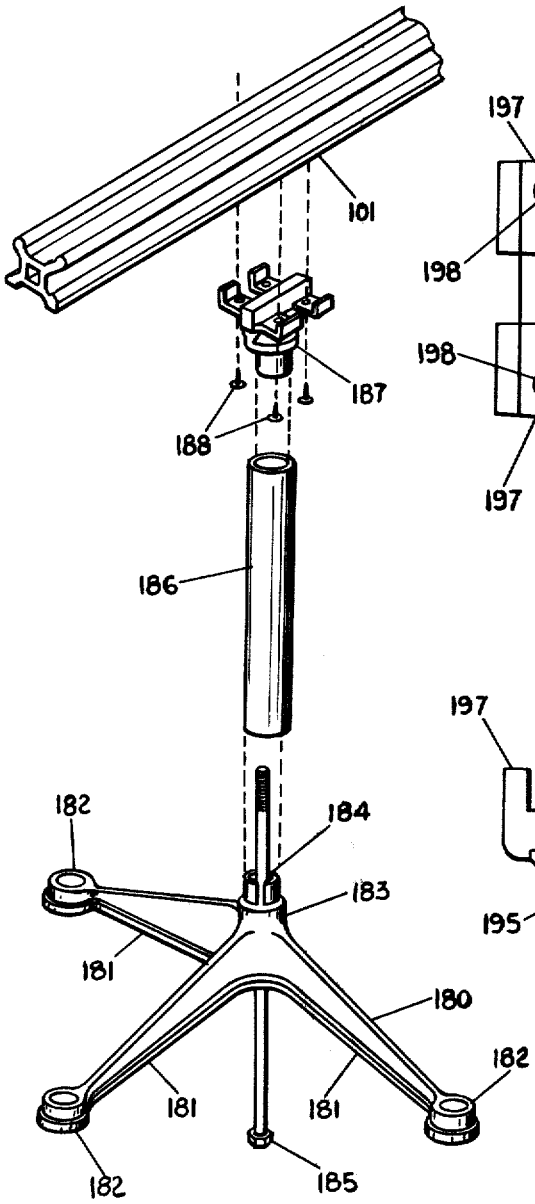
FIG. 6 is an exploded view of the pedestal assembly in positional relationship with the support beam.

FIG. 6 depicts an exploded view of pedestal assembly 102. Pedestal assembly 102 provides a means for supporting, at predetermined heights above ground level, the support beam 101 and, accordingly, the various furniture items secured thereto. Assembly 102 comprises a base structure 180 having three elongated arms 181, each terminating in support flanges 182. Support flanges 182 can be of various shapes and preferrably comprise a material which prohibits scratching and excessive noise when moved upon the particular floor where the associated furniture arrangement is to be utilized. The elongated arms 181 are connected together by a central portion 183 having a vertical bore 184 extending therethrough. A draw rod 185 extends upwardly through bore 184 and further through a leg structure 186 comprising a tubular portion which rests on the center portion 183 and has an inner space through which draw rod 185 extends. The draw rod 185 is attached to a connecting means comprising a leg-to-beam connector 187 subsequently described in greater detail herein. The leg-to-beam connector 187 is attached to the support beam 101 by means of screws 188 shown in FIG. 6.

Figure 7:
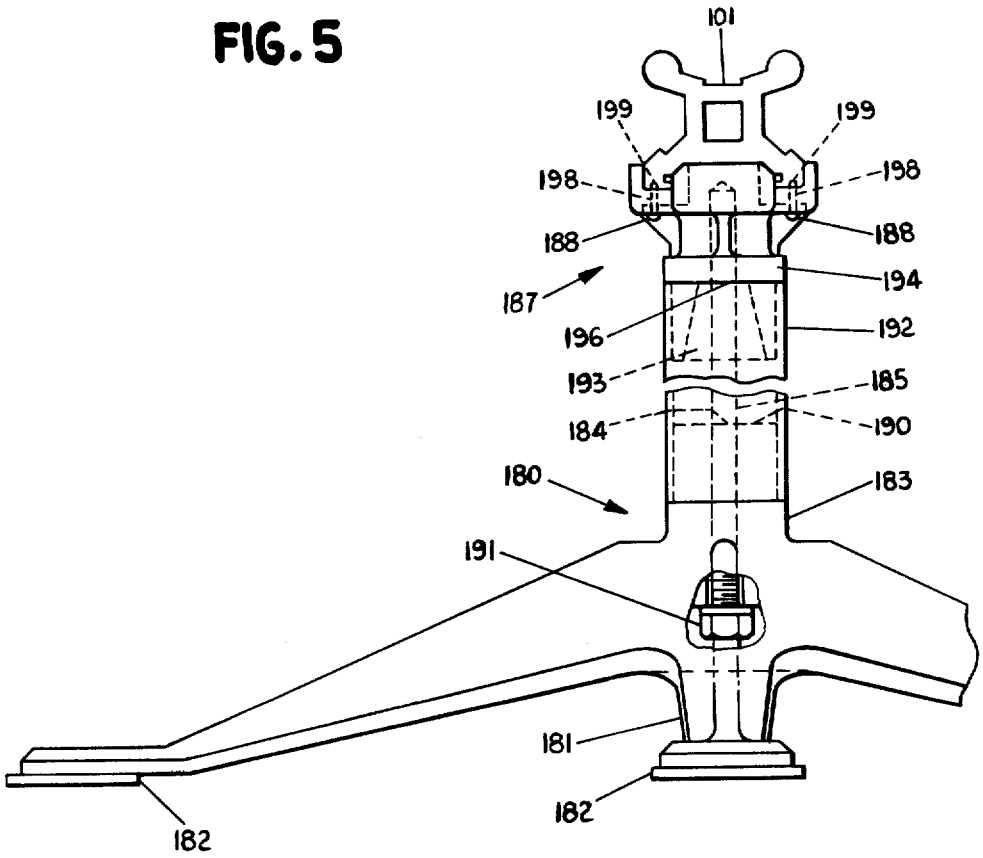
FIG. 7 is a side view of the pedestal assembly and its corresponding connection to the support beam.
Figure 8:
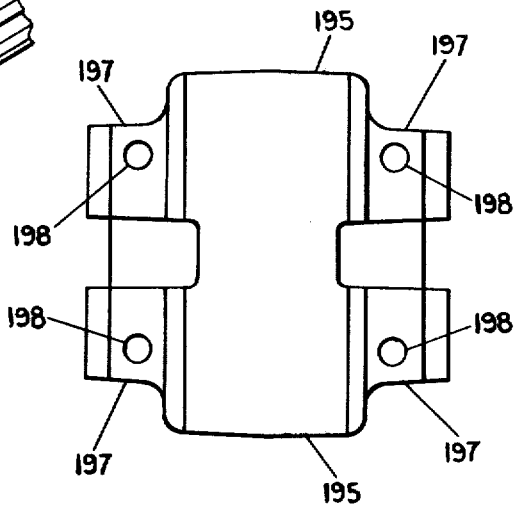
FIG. 8 is a top view of a leg-to-beam connector of the pedestal assembly shown in FIG. 6.
Figure 9:
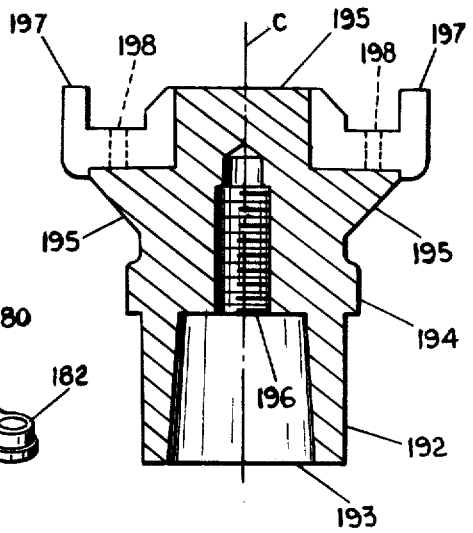
FIG. 9 is a broken side view of the leg-to-beam connector shown in FIG. 6.

FIG. 7 depicts a side view of pedestal assembly 102 and its corresponding connection to support beam 101. To clarify the structure of the leg-to-beam connector 187 described with respect to FIG. 6, FIGS. 8 and 9 depict a top view and a broken side view, respectively, of connector 187. Specifically with reference to FIG. 7, the draw rod 185 is extended upward through the vertical bore 184 and the center portion 183 of base 180 described with respect to FIG. 6. The center portion 183 of base 180 also comprises a tubular flange 190 which has a diameter slightly smaller than the lower part of center portion 183. Tubular flange 190 has a slight inward angular draft and the leg 186 of the pedestal assembly 102 rests on the lower part of center portion 183 abutting the tubular flange 190. The draw rod 185 is received into the vertical bore 184 such that the draw rod is threadably engaged at one end with the vertical bore within the center portion 183. The draw rod 185 is then secured to the base 180 by means such as a hex nut 181 as shown in FIG. 7.

The connection of the leg-to-beam connector 187 to the leg 186 and support beam 101 will now be described with respect to FIGS. 7 through 9. The leg-to-beam connector 187 comprises a lower tubular flange 192 extending downward from other structures of the connector. The tubular flange 192 comprises an inner vertical bore 193 having surfaces which form an upward inner angular draft. The leg 186 is received around the tubular flange 192 and supports a second circular flange 194 having a diameter larger than that of flange 192. The connector 187 also comprises a support section 195 which is above the second flange 194 and is shaped to extend linearly with support beam 101. A vertical bore 196 extends through the section 195 and the draw rod 186 is threadably received therein. Extending integrally from support section 195 are four supporting flanges 197. Flanges 197 are shaped such as to mate and provide support with the surfaces of lower extending flanges 129 of support beam 101 which are previously described with respect to FIG. 3. The supporting flanges 197 comprise vertical bores 198 which can be positioned directly beneath corresponding vertical bores 199 which extend partially through the lower extending flanges 129 of beam 101. Screws 188 can then be threadably received through corresponding vertical bores 198 and 199 to secure the connector 187 to the beam 101.

The previous description of the various elements of desk arrangement 100 shown in FIG. 1 merely illustrate one particular embodiment of a furniture arrangement in accordance with the invention. It should be noted that with the previously described support beam 101 and various bracket assemblies connectable thereto, functional furniture items such as work surface 106 and desk files 104 are limited neither to any specific linear position along beam 101 nor to any specific positional relationship with respect to each other. Further, support beam 101 is not limited to any particular length. Various lengths may be utilized in accordance with particular needs of the user. Additionally, work surface 106 and files 104 can be of various sizes dependent on user needs. Subsequent paragraphs and drawings herein describe and depict other furniture arrangements in accordance with the invention.

Figure 10:
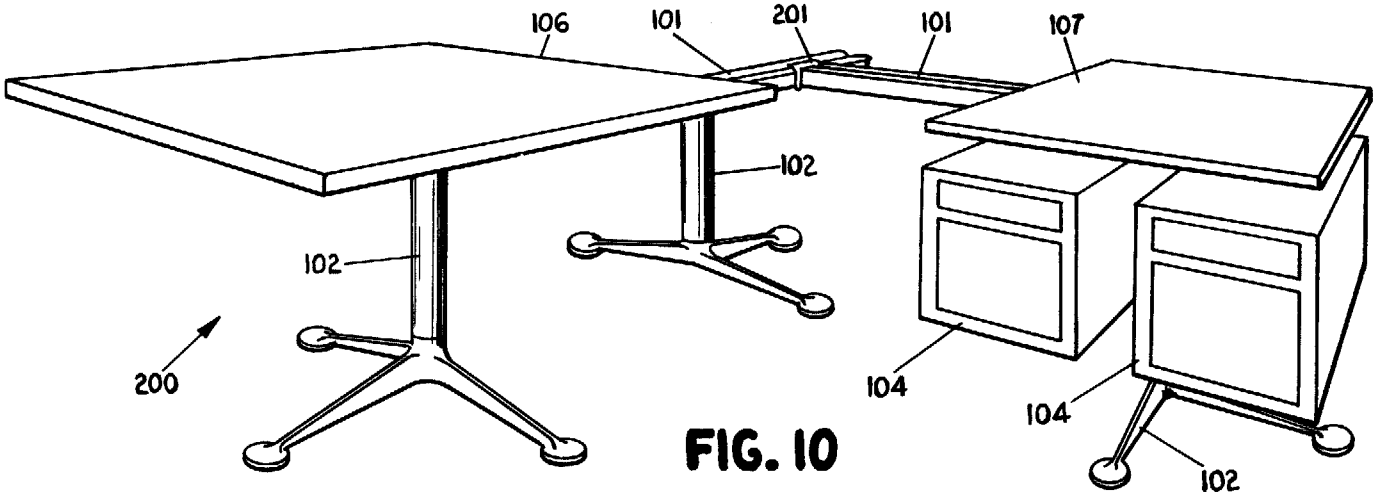
FIG. 10 is a perspective view of another illustrative embodiment of a furniture arrangement in accordance with the invention.

In addition to providing furniture arrangements utilizing a single support beam 101 with various functional furniture items and connecting assemblies attached thereto, a furniture system in accordance with the invention further provides for greater functional capacity with furniture arrangements which utilize a plurality of support beams 101 connected in an angular relationship with respect to each other. FIG. 10 illustrates in perspective view such a furniture arrangement 200 using several of the functional furniture elements and connecting assemblies previously described with respect to FIGS. 1 through 9.

Furniture arrangement 200 may be described as an L-unit desk arrangement 200 and comprises the functional furniture elements work surface 106, two desk files 104 and small work surface 107 as shown in FIG. 10. The arrangement 200 utilizes three pedestal assemblies 102 and a pair of support beams 101. The support beams 101 are connected together in perpendicular fashion by means of a beam-to-beam connector 201. With the exception of beam-to-beam connector 201 and small work surface 107, each of the aforementioned furniture elements has been previously described with respect to FIGS. 1 through 9. Though not shown in FIG. 10, work surface 106 and desk files 104 are secured to support beams 101 by means such as the previously described bracket assemblies 105 and 103, respectively. Small work surface 107 comprises a smaller working area than surface 106, but can utilize a connecting assembly (not shown in FIG. 10) to support beam 101 similar in structure to top bracket assembly 105 previously described herein.

Figure 11:
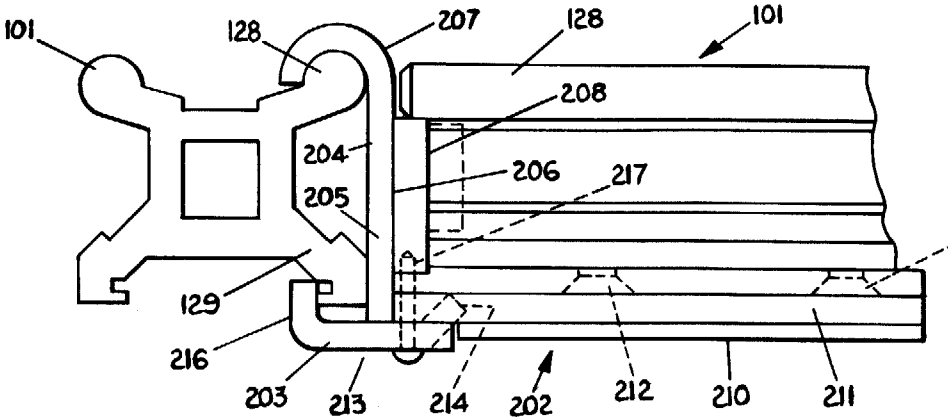
FIG. 11 is a side view of the structure of a beam-to-beam connector assembly and its cooperation with the two support beams of the furniture arrangement shown in FIG. 10.
Figure 12:
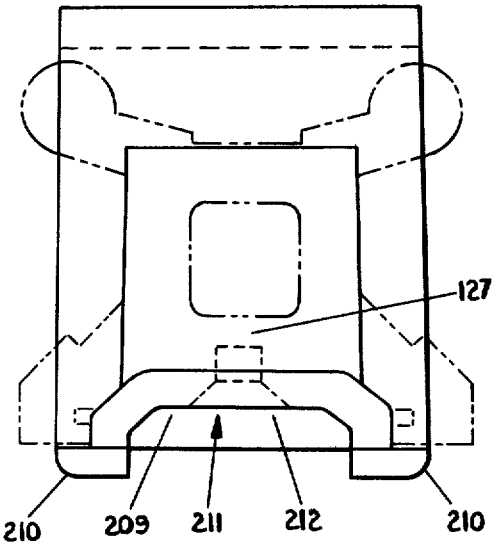
FIG. 12 is a side view perpendicular to the view shown in FIG. 11 of the beam-to-beam connector assembly and its cooperation with the two support beams of the furniture arrngement shown in FIG. 10.
Figure 13:
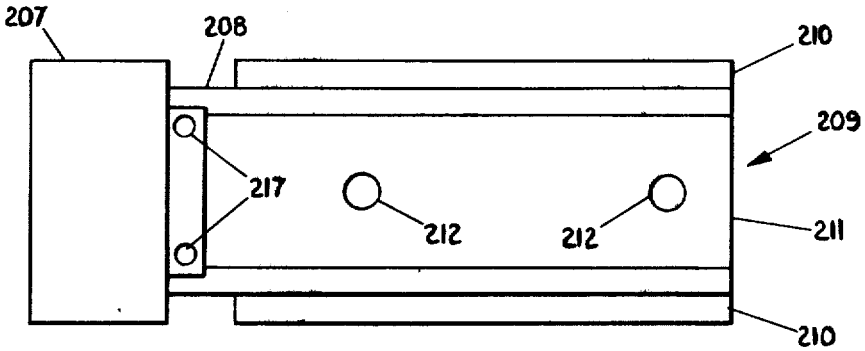
FIG. 13 is top view of the structure of the beam-to-beam connector assembly shown in FIG. 10.

FIGS. 11 through 13 depict the structure of beam-to-beam connector assembly 201 and its cooperation with the two support beams 101 shown in FIG. 10. Specifically, FIG. 11 depicts a side view of connector assembly 201 and its corresponding attachments to each of the support beams 101. The beam-to-beam connector assembly 201 comprises two structures, a connector 202 and a connector clip 203 as shown in FIG. 11. To clarify the structure of connector 202, FIGS. 12 and 13 depict end and top views, respectively, of connector 202. With reference to FIGS. 11 through 13, connector 202 comprises a vertical portion 204 having one surface 205 which at its lower end abuts one of the lower flanges 129 of one of the beams 101 previously described with respect to FIG. 3. An opposite surface 206 of the vertical portion 204 abuts the rounded upper flanges 128 of the other support beam 101. The vertical portion 204 terminates at its upper end in a curved flange 207 which mates reflectively against one of the rounded upper flanges 128 of one of the support beams 101 as shown in FIG. 11. A second vertical portion 208 is integral with the vertical portion 204 and provides a vertical support for the rounded upper flanges 128 of one of the support beams 101 also as shown in FIG. 11.

Extending horizontally from the vertical portions 204 and 208 is an extending flange 209. The extending flange 209 comprises a pair of lower end flanges 210 connected to and integral with an upper central portion 211. The upper central portion 211 has a pair of vertical bores 212 which extend partially into the bottom horizontal section 127 of one of the support beams 101. Flat head screws can be threadably received therethrough to attach the connector 202 directly to one of the support beams 101.

Figure 14:
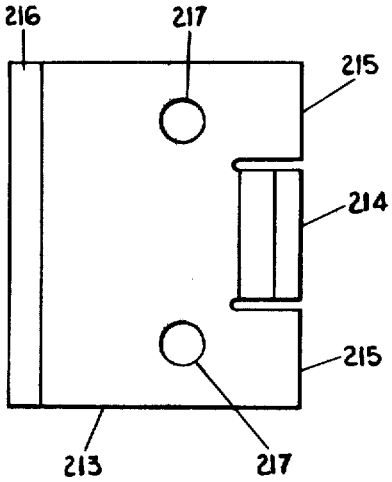
FIG. 14 is a top view of the connector clip utilized in the beam-to-beam connector assembly shown in FIG. 11.
Figure 15:
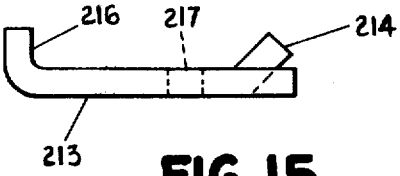
FIG. 15 is a side view of the connector clip utilized in the beam-to-beam connector assembly shown in FIG. 11.

The connector assembly 201 is further secured to the support beams 101 by means of the connector clip 203 shown in FIG. 11. To further clarify the structure of clip 203, top and side views of the clip are shown in FIGS. 14 and 15, respectively. With reference to FIGS. 11, 14 and 15, the clip 203 comprises a horizontal portion 213 having a center flange 214 which extends upwardly at an angle which can, for example, be a 45° angle with a horizontal plane. This center flange 214 is shaped to abut the upper central portion 211 of the horizontal extending flange 209 of connector 202 as shown in FIG. 11. The horizontal portion 213 of connector clip 203 also comprises end flanges 215 which mate with the lower end flanges 210 of the connector 202 as shown in FIG. 11. Connector 203 terminates at one end in a curved flange 216 which abuts one of the lower flanges 129 of one of the support beams 101 as shown in FIG. 11. The connector clip 203 is secured to the connector 202 by means of screws which can be threadably received into a pair of vertical bores 217 which extend through the horizontal section 213 of clip 203 and the second vertical portion 208 of the connector 202.

Figure 16:
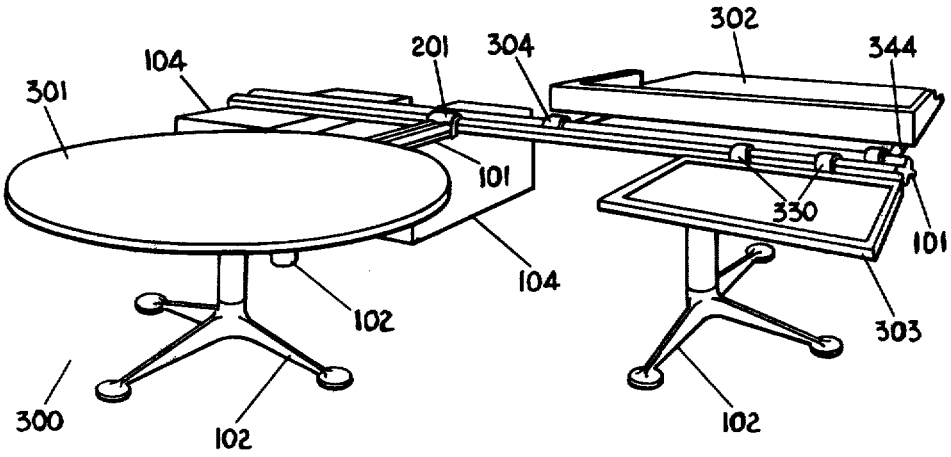
FIG. 16 is a perspective view of a further illustrative embodiment of a furniture arrangement in accordance with the invention.

Other furniture arrangements which can be constructed in accordance with the invention utilize additional types of functional furniture items and corresponding bracket assemblies. FIG. 16 illustrates in perspective view a furniture arrangement 300 having several functional furniture items including a circular work surface 301, a pair of partially shown desk files 104, a project table 302 and a machine table 303. Furniture arrangement 300 utilizes three pedestal assemblies 102 and a pair of support beams 101 interconnected by means of a beam-to-beam connector 201. The circular work surface 301 can be connected to one of the support beams 101 in a manner similar to the connection of work surface 106 previously described herein with respect to FIG. 3. Additionally, the connection of desk files 104 to one of the support beams 101 has also been previously described herein with respect to FIG. 5. Further, the utilization of pedestal assemblies 102 and beam-to-beam connector assembly 201 has previously been described herein with respect to FIGS. 6 and 11, respectively. The furniture items not shown in the previously described furniture arrangements 100 and 200 comprise the project table 302 and the machine table 303 with their corresponding connecting bracket assemblies 304 and 330 respectively.

Figure 17:
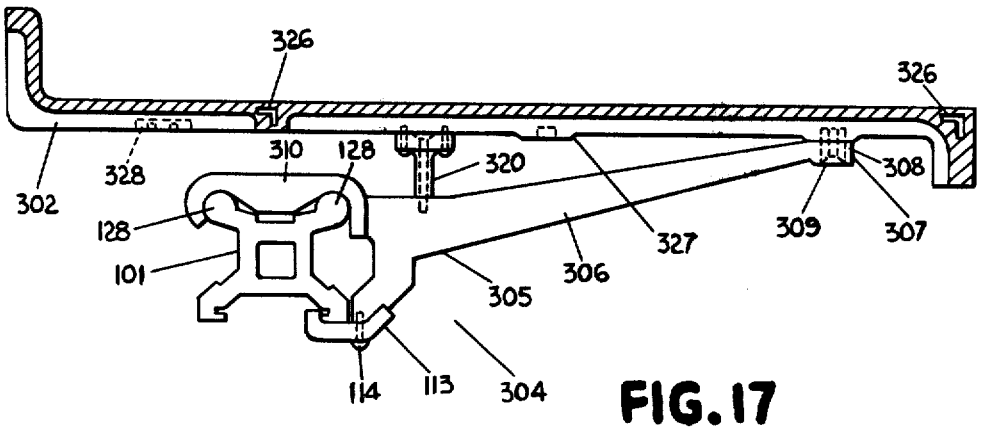
FIG. 17 is a side view of a project table and its corresponding connection to the support beam of the furniture arrangement shown in FIG. 16.

FIG. 17 depicts a partially sectionalized side view of the project table 302 and its connection to one of the support beams 101 by means of connecting bracket assembly 304. Assembly 304 is designated a "half-table bracket" assembly and, as subsequently discussed herein, can be utilized in connection with selected other furniture items. Half-table bracket assembly 304 comprises a half-table bracket 305 and a connector clip 113 as shown in FIG. 17. The structure of the half-tube bracket 305 is similar to that of one of the top brackets 110 previously described herein and depicted in FIGS. 3 and 4. Specifically, the half-table bracket 305 comprises an elongated arm 306 which extends perpendicularly to the linear structure of support beam 101. The elongated arm 306 terminates integrally with an attaching flange 307 utilized to secure the half-table bracket assembly 304 to the project table 302. The attaching flange 307 comprises a vertical bore 308 extending completely therethrough. Bore 308 also extends partially into the bottom surface of the project table 302 and connecting means such as the flat-head screw 309 shown in FIG. 17 can be threadably received through the bottom of the attaching flange 307 to secure the project table 302 thereto.

The elongated arm 306 is also integral with a central connecting portion 310 which is utilized to provide support of half-table bracket 305 upon the beam 101. The central connecting portion 310 is shaped in a reflective manner to the previously described rounded upper flanges 128 of the support beam 101 and is cooperable therewith to provide the requisite vertical support. The half-table bracket 305 is further secured to the support beam 101 by means of a connecting clip 113 and cap screw 114 as shown in FIG. 17. Connecting clip 113 was previously described herein and depicted in FIGS. 3 and 3*a* of the drawings.

Figure 18:
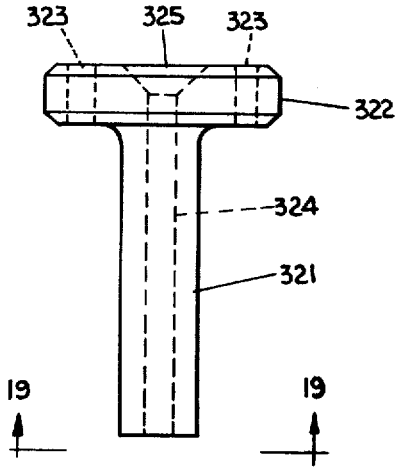
FIG. 18 is a side view of the project table support post shown in FIG. 17.
Figure 19:
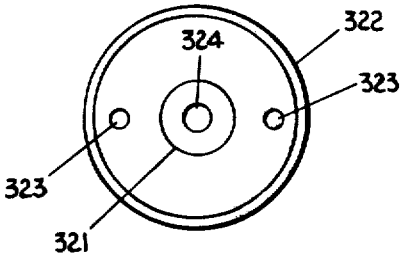
FIG. 19 is a sectionalized view of the project table support post taken along line 19—19.

The project table 302 is further supported by means of a project-table support post 320 shown in FIGS. 17 through 19 and will be described with respect thereto. Support post 320 is disposed between the half-table bracket 305 and the project table 302 and comprises a central vertical section 321 which rests atop elongated arm 306 of the bracket 305. Connected integrally at the top of the vertical portion 321 is a horizontal flange 322. A pair of vertical bores 323 extend completely through the flange 322 and connecting means such as cap screws are threadably received through the bores 323 and partially through the project table 302 to secure the support post 320 thereto. A further vertical bore 324 extends completely through both the horizontal flange 322 and the vertical portion 321. Connecting means such as a flat-head screw 325 is threadably received through the vertical bore 324 and partially into the elongated arm 306 of the half-table bracket 305 to secure the support post 320 to bracket 305.

FIG. 17 also depicts the project table 302 in a partially sectionalized side view. In accordance with the invention, the project table can comprise a hollow inner area which can be injected with a rigid foam material such as polyurethane foam to provide substantial support thereto. Additionally, spacer bars such as bars 326 shown in FIG. 17 can be inserted within the polyurethane foam to provide additional strength and support. Further, the spacial position of the project table 302 relative to the support beam 101 can be adjusted by connecting the attaching flange 307 of the half-table bracket assembly 304 at the lower portion 327 of the project table 302 shown in FIG. 17. Correspondingly, the project table support post 320 is then also connected at a different location of the project table 302, specifically at the lower portion 328.

Figure 20:
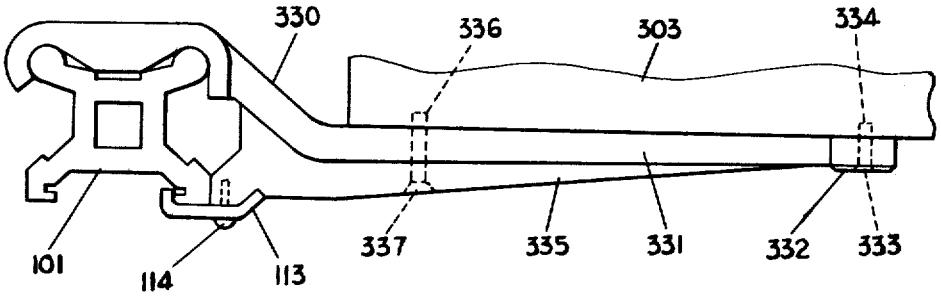
FIG. 20 is a side view of a machine table and its corresponding connection to the support beam of the furniture arrangement shown in FIG. 16.

FIG. 20 depicts a side view of the support beam 101 with the machine table 303 secured thereto by means of a machine-table bracket assembly 330. Bracket assembly 330 is similar in structure to the previously-described half-table bracket assembly 304. However, as shown in FIG. 20, an elongated arm 331 of the machine-table bracket assembly 330 extends horizontally from the support beam 101. The elongated arm 331 terminates integrally with an attaching flange 332 having a vertical bore 333 therethrough. The vertical bore 333 extends partially into the machine table 303 and connecting means such as a flat-head screw 334 can be utilized to secure in part the bracket assembly 330 to the machine table 303. The elongated arm 331 comprises a lower return flange 335 having a vertical bore 336 extending completely therethrough and partially extending into the machine table 303. Connecting means, such as a flat-head screw 337, can be utilized to further secure the bracket assembly 330 to the machine table 303. Similar to the previously-described half-table bracket assembly 304, a connecting clip 113 with a cap screw 114 can be utilized to rigidly secure the bracket assembly 330 to support beam 101.

Figure 21:
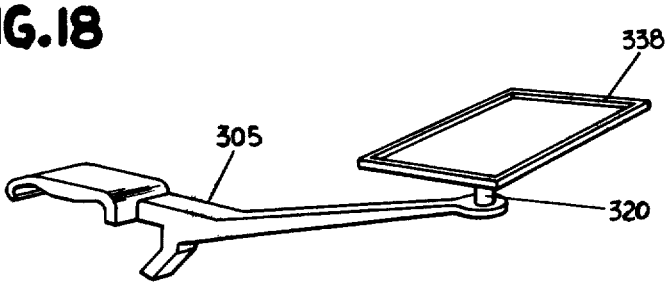
FIG. 21 is a perspective view of a telephone tray secured to the half-table bracket shown in FIG. 17.

Although the various bracket assemblies which can be utilized in accordance with the invention have been described herein with respect to specific furniture items, certain of these bracket assemblies can be utilized for a plurality of different furniture items. For example, FIG. 21 depicts in perspective view the half-table bracket 305 previously described with respect to FIG. 17 utilized in connection with the support post 320 for purposes of mounting a telephone tray 338 thereto. Indeed, numerous other types of furniture items, such as ash trays, reading stands, and similar functional components can be utilized with numerous types of bracket assemblies, some of which have been described herein and provide a variety of furniture arrangements.

Figure 22:
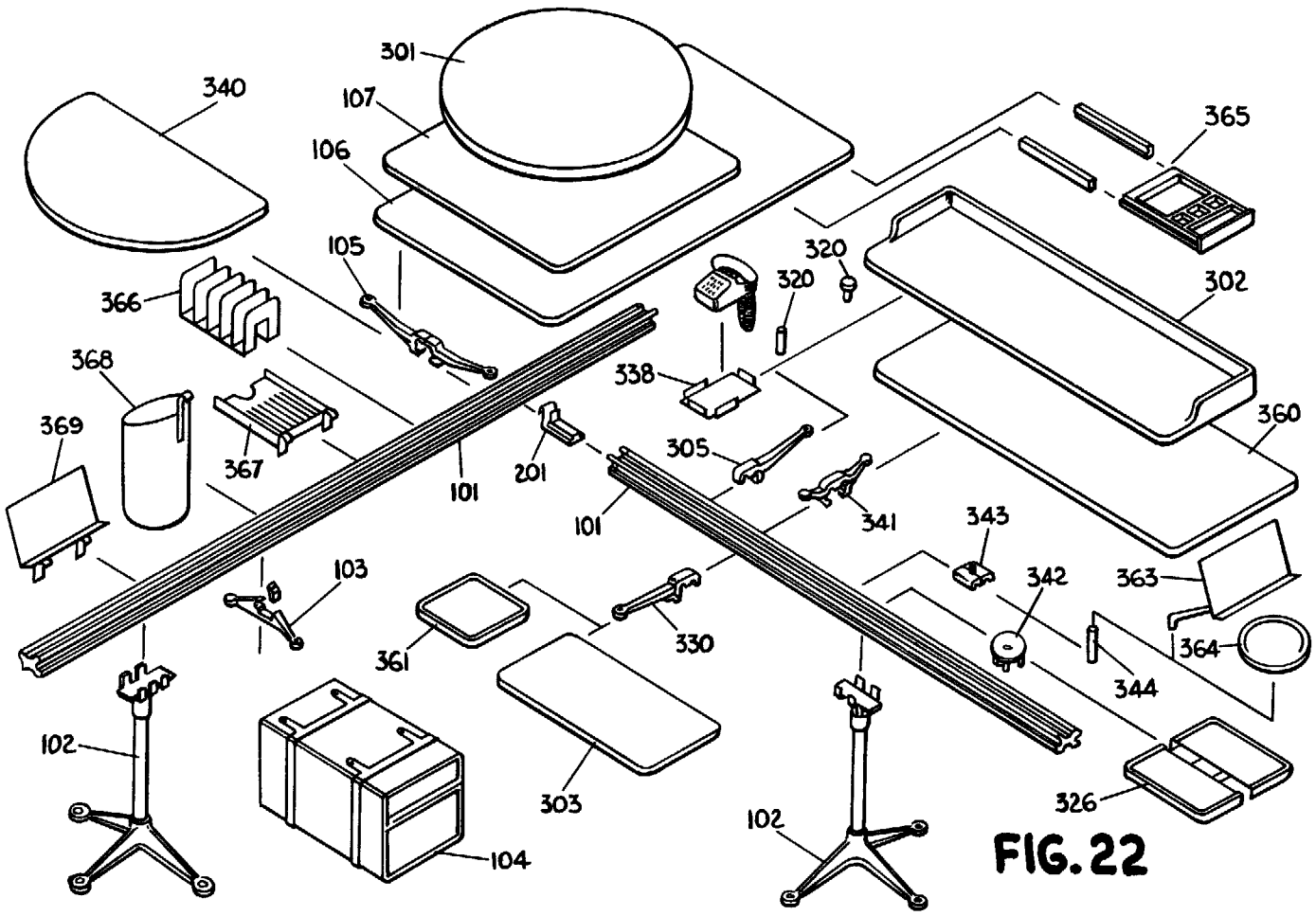
FIG. 22 is a perspective view of the support beams, furniture items and connecting assemblies of the furniture arrangements shown in FIGS. 1, 10 and 16, and depicts other furniture items and connecting assemblies which can be utilized for construction of furniture arrangements in accordance with the invention.

FIG. 22 is a perspective view depicting various types of connecting bracket assemblies and furniture items which can be utilized in accordance with the invention to provide differing furniture arrangements. Table A below lists the various connecting assemblies and associated connectable furniture items shown in FIG. 22. Numerous of these connecting assemblies and furniture items have been described herein in accordance with the illustrative furniture arrangements 100, 200 and 300. Other connecting assemblies and furniture items, though not depicted in specific detail, are shown in FIG. 22 for purposes of illustrating the numerous types of furniture items which can be utilized in accordance with the invention to provide a variety of furniture arrangements.

TABLE A

| Connecting Assembly | Functional Connectable Furniture Item |
|---|---|
| Beam-to-beam connector 201 | Interconnection of support beams 101 |
| File bracket assembly 103 | Desk file 104 |
| Work surface bracket assembly 105 | Rectangular work surface 106<br>Square work surface 107<br>Circular work surface 301<br>Semicircular work surface 340 |
| Narrow work surface bracket assembly 341 | Narrow work surface 360 |
| Half-table bracket assembly 305 | Project table 302 (with project table post 320) |

TABLE A-continued

| Connecting Assembly | Functional Connectable Furniture Item |
|---|---|
| | Telephone tray 338 (with post 320) |
| Machine table bracket assembly 330 | Rectangular machine table 303 |
| | Typewriter-CRT table 361 |
| Swivel bracket assembly 342 | Adjustable computer table 362 |
| Wedge bracket assembly 343 with center post 344 | Reader stand 363 |
| | Circular tray 364 |
| Direct connection to work surface | Work surface drawer assembly 365 |
| Direct connection to beam 101 | File storage tray 366 |
| | Paper bin 367 |
| | Trash bin 368 |
| | Display ledge 369 |

The various connecting assemblies and furniture items described hereinbefore and listed in Table A illustrate the high degree of versatility of structural arrangements and selectivity of furniture items available to meet the differing objective and subjective needs of users.

The work surface bracket assembly 105 can be utilized for purposes of securing to the support beam 101 any of the variously shaped work surfaces 106, 107, and 301. Further, however, other shapes of work surfaces can be utilized, such as the semi-circular work surface 340 depicted in FIG. 22. Additionally, a work surface bracket assembly 341, having a structure similar to that of work surface bracket assembly 105 but having elongated arms shorter in length than those of the arms of assembly 105 can be utilized for smaller work surfaces such as narrow work surface 360. As previously discussed, the machine table bracket assembly 330 can be utilized for purposes of securing a rectangular machine table 303 to the support beam 101. Additionally, the machine table bracket assembly 330 can be utilized for purposes of securing a table of different size and function to the beam 101, such as the typewriter-CRT table 361 having a generally square shape as shown in FIG. 22.

Connecting assemblies of different funtional design than those previously discussed herein can be utilized with the support beam 101 for purposes of securing other types of furniture items. For example, FIG. 22 depicts a swivel bracket assembly 342 which can be secured over the upper radial flanges of the support beam 101 and further secured to a work surface such as the adjustable computer table 362 as shown in FIG. 22. The bracket assembly 342 is adapted to rotate completely around a 360° arc for purposes of providing a variety of positions for the computer table 362 without the necessity of performing any mechanical functions to vary the computer table position. An additional type of connecting assembly shown in FIG. 22 is the wedge bracket assembly 343 with a center post 344. The wedge bracket assembly 343 can be positioned over the upper radial flanges of the support beam 101 and the center post 344 can be secured thereto. Bracket assembly 343 provides a means for securing furniture items to the support beam 101 in a spacial position directly above the beam 101 rather than positioning furniture items laterally to beam 101 as is accomplished by others of the bracket assemblies described herein. Wedge bracket assembly 343 can be utilized, for example, with such furniture items as the reader stand 363 and circular tray 364 as shown in FIG. 22.

Other furniture items in accordance with the invention do not necessarily require specific connecting assemblies for purposes of securing them to the support beam 101. For example, a work surface drawer assembly 365 such as that shown in FIG. 22 can be directly secured to one of the work surfaces 106 in any manner commonly known in the art. Additionally, various furniture items can be directly secured to the support beam 101 by means of connecting brackets permanently mounted on the furniture items themselves. For example, FIG. 22 shows in a perspective manner a file storage tray 366 which can be mounted directly on the support beam 101 in any manner which provides a secure attachment thereto. Additionally, by means of securing clamps or the like permanently mounted to the furniture items, a paper bin 367, trash bin 368, and display ledge 369 can be secured directly to the support beam 101 as required.

Figure 23:
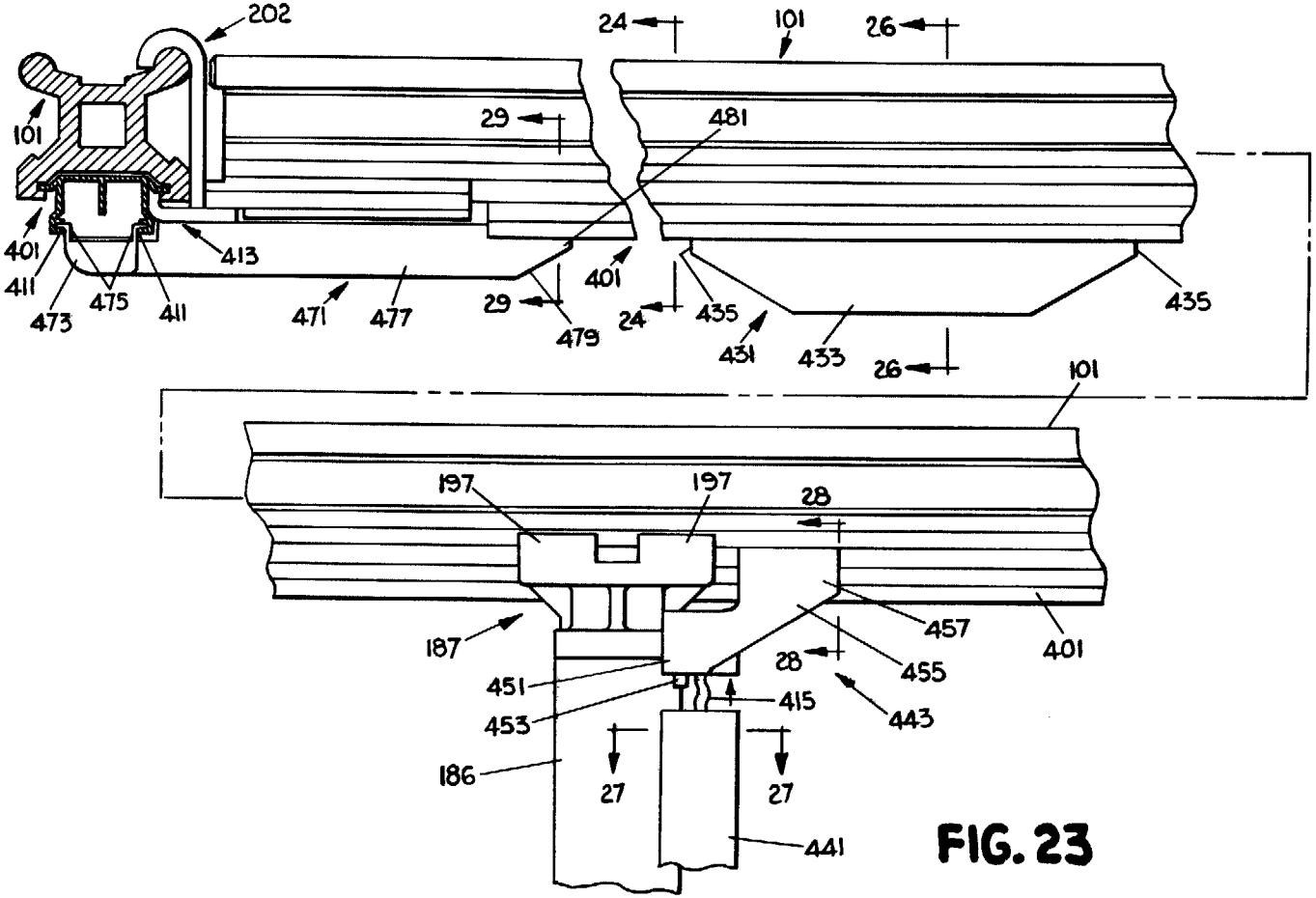
FIG. 23 is a side view of one support beam and an end sectional view of another support beam with various wire management components connected thereto.

One further advantage to furniture systems constructed in accordance with the invention is the ability of providing wire management facilities which are both functional and also sufficiently integrated with the furniture systems such that there is no loss of asthetic appearance. FIG. 23 depicts a side view of one support beam 101 connected to another support beam 101 (shown in sectional and view) through the previously described beam to beam connector 202. Also depicted in FIG. 23 is a support leg 186 connected to one of the beams 101 through previously described leg-to-beam connector 187. Attached to these previously described furniture components are wire management components which provide a means for conveniently and safely transporting electrical wires and similar materials through the constructed furniture systems.

The wire management components comprise a beam wire manager 401, cover 413, extension cover 431, vertical wire manager 441, elbow 443, and beam-to-beam manager 471. Each of these components will now be described with reference to FIGS. 23 through 29.

Figure 24:
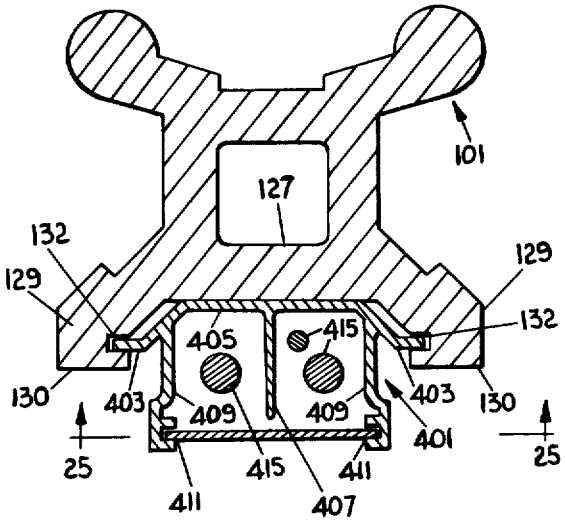
FIG. 24 is an end sectional view of one support beam and associated wire manager taken along section lines 24—24 of FIG. 23.

As depicted in the sectional view of FIG. 24, a beam wire manager 401 comprises two horizontal flanges 403 each receivable into one of the respective slots 132 of beam 101 previously described and depicted in FIG. *3b*. The flanges 403 are integrally connected to a horizontal upper portion 405 which extends below the lower horizontal portion 127 of the beam. In the center of the horizontal portion 405 and connected integrally therewith is a dividing flange 407 which extends downward from portion 405. The divider flange 407 provides a means for separating electrical wires which can cause operational problems if they are spaced apart only by an air medium. For example, the divider 407 may inhibit cross capacitance which can cause commony known electrical difficulties.

At each end of the horizontal portion 405 are additional flanges 409 extending downward therefrom with inner slots 411 near the bottom sections thereof. The slots 411 can be utilized to support a horizontally extending wire cover 413 at each end thereof. The utilization of beam wire manager 401 and wire manager cover 413 thus provides a hidden receptacle below the support beam 101 to carry materials such as electrical wires 415 shown in cross section in FIG. 24.

Figure 25:
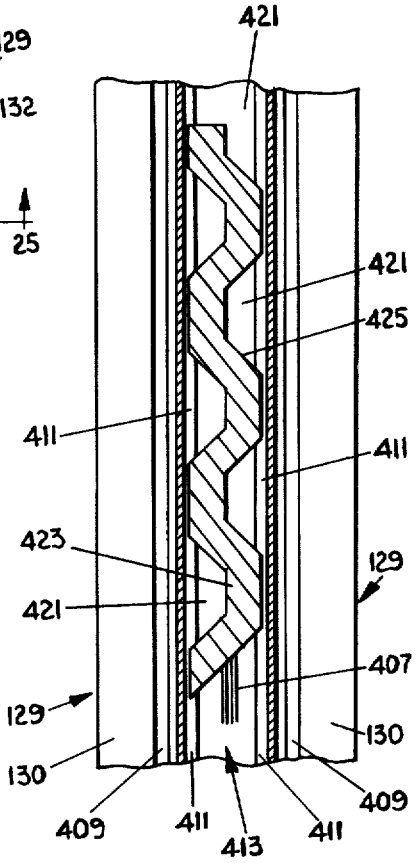
FIG. 25 is a sectional view of the lower surfaces of the associated wire manager taken along section lines 25—25 of FIG. 24.

The wire manager cover 413 can be a flat solid piece of material or, as depicted in the sectional view of FIG. 25, can be configured to provide vertical support for wires 415 while simultaneously allowing the wires to be transported through the slots 421 which are formed by the zagged configuration of the cover 413. The zagged configuration of the wire manager cover 413 comprises linearly extending portions 423 integrally connected with angled portions 425. One edge of each of the linearly extending portions 423 is received within one of the slots 411 of the wire manager 401.

Figure 26:
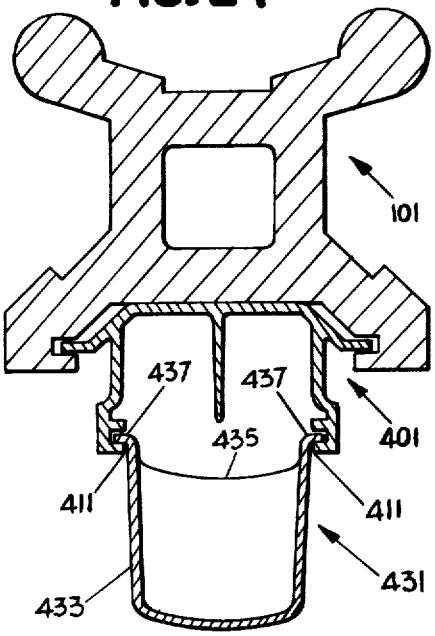
FIG. 26 is an end sectional view of the wire manager extension cover taken along section lines 26—26 of FIG. 23.

Certain types of wires may require greater space than that provided by wire manager 401 when utilized in connection with wire manager cover 413. To provide such additional space at any of various selected locations, a wire manager extension cover 431 depicted in FIG. 23 can be utilized with the wire manager 401. FIG. 26 depicts a cross sectional end view of beam 101, wire manager 401, and wire manager extension cover 431. The extension cover 431 comprises a section 433 linearly extending below the beam 101 and angled upwardly at the two end portions thereof. Section 433 is closed at each of its end sections by horizontally extending cover plates 435. Extending upwardly from and integral with each vertical side of the extension section 433 are flanges 437 which are angled outwardly and received within the slots 411 of wire manager 401. The cover 431 provides a means for transporting, in a hidden manner, large wires or other bulky materials which require greater space than that provided by a flat cover horizontally extending between each of the slots 411 of wire manager 401.

Figure 27:
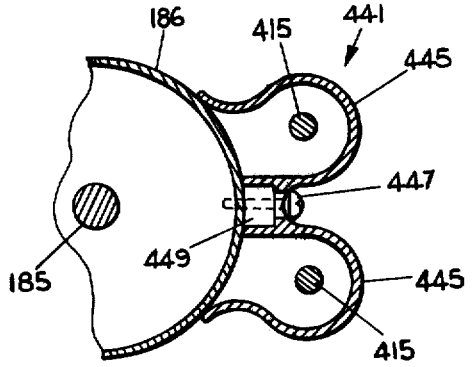
FIG. 27 is a top sectional view of a furniture leg with vertical wire management components connected thereto taken along section lines 27—27 of FIG. 23.
Figure 28:
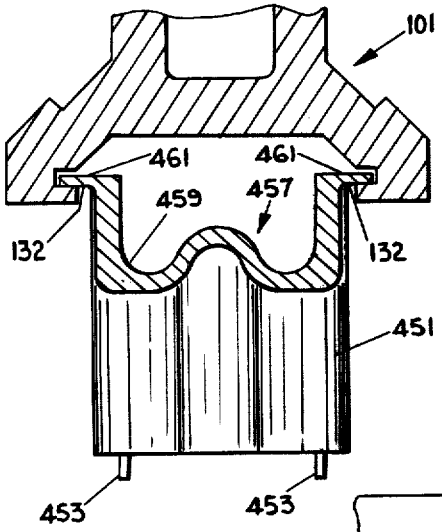
FIG. 28 is a sectional view of the wire manager elbow taken along section lines 28—28 of FIG. 23.

Additional means are provided to transport wires from a horizontally extending beam 101 downwardly along the side of one of the previously described legs 186. FIG. 23 depicts a vertical wire manager 411 utilized in conjunction with a wire manager elbow 443 for this purpose. A sectional top view of vertical wire manager 441 is shown in FIG. 27 while a sectional end view of wire manager elbow 443 is shown in FIG. 28. Referring specifically to FIGS. 23 and 27, the vertical wire manager 441 extends vertically upward and is disposed along one of the legs 186 previously described herein. The wire manager 441 comprises a pair of semi-circular portions 445, the ends of which abut the outer surface of leg 186 and form hidden closed receiptacles therewith for wire 415 to extend therethrough. The portions 445 are connected integrally together at a common central portion which is directly attached to the leg 186 by means of a self-tapping screw 447 received through a bore 449 positioned between the semi-circular portions 445.

Referring to FIGS. 23 and 28, the wire manager elbow 443 is positioned on the leg 186 above the vertical wier manager 441. The elbow 443 comprises a vertically extending flange 451 having a structural configuration which "matches" that of the vertical wire manager 441. Snap brackets 453 are positioned at each side of the flange 451 at the lower section thereof and secure the elbow 443 to semi-circular portions 445 of the vertical wire manager 441, thus providing a rigid connection therewith. The vertically extnding flange 451 is integrally connected to an angled portion 455 which is integral with a horizontally extending flange 457. The flange 457 comprises a linear section 459 which is integral with and connected at its ends to outwardly extending flanges 461 receivable within slots 132 of the beam 101. Wires 415 can thus be transported from their position along the lower portion of beam 101 through the wire manager elbow 443 and downwardly through the vertical wire manager 441.

Figure 29:
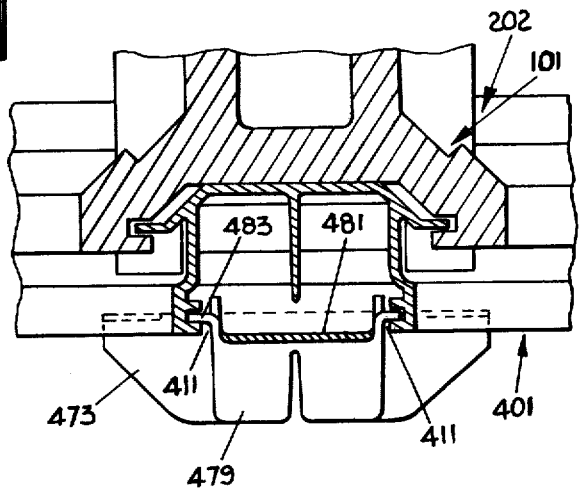
FIG. 29 is a sectional view of the beam-to-beam wire manager taken along section lines 29—29 of FIG. 23.

A further difficulty in wire management comprises the problem of extending wires from underneath one of the beams 101 to a perpendicularly extending beam 101 which is connected to the first beam by means of the previously described beam-to-beam wire manager 471 depicted in FIGS. 23 and 29 can be utilized for the aforementioned function. Referring to there drawings, the beam-to-beam wire manager 471 comprises a "cupped" portion 473 with outwardly extending flanges 475 receivable into the slots 411 of a wire manager 401 extending linearly along one of the beams 101. Integral with the cupped section 473 is a perpendicularly section 477 extending linearly along the bottom portion of the other of support beams 101 and on associated wire manager 401. Section 477 terminates in an angled portion 479 shown in horizontal cross section in FIG. 29. The angled portion 479 extends upwardly and terminates in a horizontal portion 481 which comprises flanges 483 at each end thereof which are receivable into the slots 411 of the horizontal wire manager 401.

It should again be noted that the various furniture items and connecting assemblies shown in FIGS. 1 through 22 and listed in Table A above are not meant to be an exhaustive enumeration of furniture items and connecting assemblies which can be utilized in accordance with the invention. Rather, these furniture items and connecting assemblies are merely illustrative of the degree of versatility available in a furniture system in accordance with the invention. Accordingly, it will be apparent to those skilled in the furniture design arts that modifications and variations of the above-described illustrative embodiments of the invention can be effected without departing from the spirit and scope of the novel concepts of the invention.

The embodiments of the invention in which an exclusive property or privilege is claimed are defined as follows:

1. In an office furniture system adapted to provide a plurality of furniture arrangements structurally variable in accordance with functional requirements of users of said furniture arrangements, said furniture system comprising:

a plurality of functional furniture components comprising variously sized work surfaces, storage files, desk files and trays;

furniture support means for supporting and positioning in differing relative spacial arrangements selective components of said plurality of functional furniture components;

pedestal means for supporting said furniture support means in a horizontal plane at a selectible working height relative to a ground level; and bracket assemblies for connecting each of said furniture components to said support means;

characterized in that said furniture support means comprises a horizontally disposed first linear support beam having a plurality of radially extending flanges and said bracket assemblies are removably clampable to at least two of said radially extending flanges.

2. An office furniture system in accordance with claim 1 characterized in that said bracket assemblies can be attached to said radially extending flanges at any of a continuum of locations along said first linear support beam.

3. An office furniture system in accordance with claim 1 characterized in that said furniture support means further comprises a second linear support beam and means to connect said second linear support beam perpendicular to said first linear support beam.

4. An office furniture system in accordance with claim 1 or claim 2 or claim 3 characterized in that said pedestal means comprises:

base means resting on said ground level for effecting stabilization of said pedestal means;

a vertically extending leg member connectable to said base means and adapted to position said furniture support means at said predetermined height relative to said ground level; and means for connecting said furniture support means to said vertically extending leg members, thereby providing a connection of said pedestal means to said furniture support means.

5. An office furniture system in accordance with claim 4 characterized in that said base means comprises a plurality of elongated arms, each terminating in a support flange resting on said ground level, and a central portion connecting together each of said plurality of elongated arms and having a vertical bore extending therethrough;

said vertically extending leg comprises a tubular portion having an inner spacial area positioned above said central portion of said base means wherein a draw rod is extendible through said tubular portion and is secured to said base means; and said means for connecting said pedestal means to said furniture support means comprises a leg-to-beam connector positionable above said tubular portion and connectable to said draw rod and to said first linear support beam.

6. An office furniture system in accordance with claim 5 characterized in that said leg-to-beam connector comprises:

a lower tubular flange positionable below said first linear support beam and comprising an inner vertical bore wherein said draw rod is received therethrough;

a support section above and connected to said lower tubular flange and shaped to extend linearly along said first linear support beam;

a plurality of supporting flanges extending integrally from said support section and shaped to mate with and provide support for certain of said radially extending flanges; and said plurality of supporting flanges having vertical bores therein positionable below corresponding vertical bores extending partially through said certain of said radially extending flanges wherein connecting means can be received therethrough for securing said leg-to-beam connector to said first linear support beam.

7. An office furniture system in accordance with claim 1 or claim 2 or claim 3 characterized in that said first linear support beam is symmetrical about a vertical plane and comprises a rectangularly-shaped portion integrally connected to said plurality of radially extending flanges.

8. An office furniture system in accordance with claim 7 characterized in that said plurality of radially extending flanges comprises:

a pair of rounded upper flanges integral with and radially extending from said rectangularly-shaped portion;

and a pair of lower flanges integral with and radially extending from said rectangularly-shaped portion.

9. An office furniture system in accordance with claim 8 characterized in that inner surfaces of said lower flanges comprise slots for retention of wire management means to conceal wiring and like materials.

10. An office furniture system in accordance with claim 1 or claim 2 or claim 3 characterized in that said bracket assemblies comprise:

a work surface bracket assembly connectable to said first linear support beam for supporting and positioning any one of said variously sized work surfaces wherein the work surface is positioned in a horizontal plane above said horizontal plane of said furniture support means;

a file bracket assembly connectable to said first linear support beam for supporting and positioning one of said desk files below said horizontal plane of said furniture support means;

a machine table bracket assembly connectable to said first linear support beam for supporting and positioning certain of said functional furniture components in a horizontal plane substantially equivalent to said horizontal plane of said furniture support means; and a centered bracket assembly connectable to said first linear support beam for supporting and positioning others of said functional furniture components directly above said first linear support beam.

11. An office furniture system in accordance with claim 1 or claim 2 or claim 3 characterized in that said radially extending flanges comprise a pair of rounded upper flanges and a pair of lower flanges integrally connected with a rectangularly-shaped portion of said first linear support beam.

12. An office furniture system in accordance with claim 11 characterized in that said bracket assemblies comprise:

a top bracket assembly for supporting and positioning any one of said variously sized work surfaces in a horizontal plane above said horizontal plane of said furniture support means, said top bracket assembly comprising:

a pair of top brackets each having an elongated arm extending perpendicularly to the linear structure of said first linear support beam when said top bracket assembly is secured to said furniture support means;

a pair of attaching flanges each integrally connected to one of said elongated arms and comprising a vertical bore extending therethrough;

a pair of central connecting portions each connected integrally to one of said elongated arms and comprising an inner surface shaped in a reflective manner to the shape of said rounded upper flanges;

means receivable through said vertical bore of each of said attaching flanges for securing said top bracket assembly to said one of said variously sized work surfaces; and clip means for securing each of said pair of top brackets to said first linear support beam.

13. An office furniture system in accordance with claim 12 characterized in that each of said elongated arms comprises an lower return flange terminating in an inner vertical surface and a lower horizontal surface having a vertical bore therethrough;

said clip means comprises a clip having a vertical bore therethrough and connectable to said lower return flange by screw means receivable through said vertical bores of said clip and said lower horizontal surface; and said inner vertical surface mates with a vertical surface of one of said radially extending lower flanges when said top bracket assembly is rigidly secured to said first linear support beam.

14. An office furniture system in accordance with claim 12 characterized in that said central connecting portions further comprise vertical surfaces having horizontal bores extending partially therethrough; and said top bracket assembly further comprises means receivable into each of said horizontal bores for connecting together said pair of top brackets.

15. An office furniture system in accordance with claim 11 characterized in that said bracket assemblies comprise a desk file bracket assembly for supporting and positioning one of said desk files in a horizontal plane generally below said horizontal plane of said furniture support means, said desk file bracket assembly comprising:

a file bracket having a pair of elongated arms extending perpendicularly from the linear structure of said first linear support beam when said desk file bracket assembly is secured to said furniture support means;

a pair of attaching flanges each integral with and terminally connected to one of said elongated arms and comprising vertical bores extending therethrough;

clamping means for rigidly securing said file bracket to said furniture support means; and means receivable through said vertical bores of said attaching flanges for securing said one of said desk files to said desk file bracket assembly below said attaching flanges.

16. An office furniture system in accordance with claim 15 characterized in that said pair of elongated arms are joined together integrally with a central connecting portion positioned below said first linear support beam;

one of said elongated arms terminates at said central connecting portion in a vertical surface and a horizontal surface having a vertical bore extending partially therethrough;

said clamping means comprises a clamp having vertical and horizontal surfaces which mate respectively with said vertical and horizontal surfaces of said one of said elongated arms; and said clamp comprises a vertical bore extending therethrough and said clamping means further comprises means receivable through said vertical bore of said clamp and through said vertical bore of said one of said elongated arms for rigidly securing said clamp to said file bracket.

17. An office furniture system in accordance with claim 16 characterized in that said clamp and the other of said elongated arms are supported in a vertical manner around lower ones of said radially extending flanges.

18. An office furniture system in accordance with claim 3 characterized in that said means for perpendicular connection of said first linear support beam to said second linear support beam comprises a beam-to-beam connector comprising:

a vertical portion having one surface mating at its lower end with a lower one of said radially extending flanges of said first linear support beam, an opposite surface mating with radially extending flanges of said second linear support beam, and terminating at its upper end in a curved flange which reflectively mates to an upper one of said radially extending flanges of said first linear support beam;

an extending flange connected to and extending horizontally from the lower end of said vertical portion and comprising vertical bores therethrough for receiving connecting means for securing said extending flange to a lower portion of said second linear support beam; and a clip having a vertical flange which mates with an inner surface of said lower one of said radially extending flanges of said first linear support beam, and a horizontal portion having a vertical bore therethrough for receiving connecting means for securing said clip to said extending flange.

19. An office furniture system in accordance with claim 1 characterized in that said certain of said work surfaces comprise hollow inner areas injectable with a foam material, and spacer bars insertible into said foam material to provide rigidity and strength to said certain of said work surfaces.

20. An office furniture system in accordance with claim 1 characterized in that certain of said bracket assemblies can be permanently mounted to certain of said functional furniture components.

21. A furniture system adapted to provide both simple and complex furniture arrangements, each having a plurality of selectively removable functional furniture components wherein the type of said furniture components of any one of said furniture arrangements can be varied in accordance with the tasks associated with the occupation of the user of said any one of said furniture arrangements, said furniture system comprising:

rail support means for supporting and positioning said plurality of selectively removable furniture components wherein said rail support means is arranged in a horizontal plane and comprises a linear support beam adapted to provide selective linear positioning of various components of said plurality of selectively removable functional furniture components;

pedestal means connectable to said rail support means at a plurality of locations along said linear support beam for effecting a stable structure of said furniture system and for supporting said linear support beam in a horizontal plane at a predetermined working height relative to a ground level;

bracket assembly means for selectively connecting said functional furniture components to said linear support beam wherein certain components of said plurality of furniture components are positionable at least in part below said horizontal plane of said rail support means and certain other components of said selectively removable furniture components are positionable at least in part above said horizontal plane of said rail support means; and said rail support means further comprises means for perpendicularly connecting said linear support beam to another linear support beam.

22. A furniture system in accordance with claim 21 characterized in that said linear support beam and said another linear support beam are adapted to provide connection of said bracket assembly means at any of a continuum of locations thereon.

23. A furniture system in accordance with claim 21 characterized in that said linear support beam comprises:

a linear rectangular structure having an upper plane and a lower plane;

at least four radial flanges projecting from said rectangular structure wherein at least two of said radial flanges extend from said upper plane of said linear support beam and at least two of said radial flanges extend from said lower plane of said linear support beam;

said radial flanges extending from said upper plane of said linear support beam having rounded surfaces and said radial flanges extending from said lower plane of said linear support beam having rectangularly-shaped surfaces;

each of said radial flanges being cooperable with another of said radial flanges for providing a connection with certain of said bracket assembly means; and each of said radial flanges extending from said lower plane having an inner surface wherein horizontal slots are provided therein for retention of wire management means for concealment of wiring elements between said flanges extending from said lower plane.

24. An office furniture system in accordance with claim 1 characterized in that said furniture system further comprises wire retention means connected to said furniture support means for retaining electrical wires and similar elements along said furniture support means for providing energy equipment at said functional furniture components.

25. An office furniture system in accordance with claim 24 characterized in that said wire retention means comprises:

first conduit means connected to said first linear support beam for horizontally retaining and concealing electrical wires linearly along said first linear support beam;

second conduit means connected to said pedestal means for vertically retaining and concealing electrical wires along said pedestal means; and elbow means intermediate to said first conduit means and to said second conduit means for retaining and concealing electrical wires passing therebetween.

26. An office furniture system in accordance with claim 25 characterized in that said first conduit means is connected to at least two of said radially extending flanges.

27. An office furniture system in accordance with claim 26 characterized in that slots are formed in forcing relationship in two adjacent radially extending flanges of said linear support beam; said first conduit means comprises an elongated housing extending along the bottom of said first linear support beam, having upper outwardly extending flanges received in said slots of said linear support beam, and having lower inwardly extending flanges forming slots therein, and a wire cover member removably positioned within said inner slots of said elongated housing.

28. An office furniture system in accordance with claim 27 characterized in that said furniture system further comprises:

a second linear support beam and means to connect said second linear support beam perpendicular to said first linear support beam;

third conduit means connected to said second linear support beam for horizontally retaining and concealing electrical wires along said second linear support beam; and means intermediate to said first conduit means connected support beam and said second conduit means for retaining and concealing electrical wires passing therebetween.

* * * * *